United States Patent [19]

Reuland

[11] 3,993,194

[45] Nov. 23, 1976

[54] METHOD AND APPARATUS FOR MONITORING THE DENSITY OF ROD-SHAPED ARTICLES, PARTICULARLY CIGARETTES AND THE LIKE

[75] Inventor: Joachim Reuland, Hamburg, Germany

[73] Assignee: Hauni-Werke Korber & Co., KG, Hamburg, Germany

[22] Filed: June 5, 1975

[21] Appl. No.: 583,965

Related U.S. Application Data

[63] Continuation-in-part of Ser. No. 499,900, Aug. 23, 1974.

[30] Foreign Application Priority Data

Aug. 30, 1973 Germany ..... 2343668
Dec. 20, 1973 Germany ..... 2363365

[52] U.S. Cl. ..... 209/81 R; 324/61 QS; 331/65; 83/102

[51] Int. Cl.[2] ..... B07C 5/08

[58] Field of Search ..... 209/81 R, 73, 74 R, 209/74 M; 324/61 R, 61 QS; 331/65; 340/235; 83/102

[56] References Cited

UNITED STATES PATENTS

| | | | |
|---|---|---|---|
| 2,729,214 | 1/1956 | Broekhuysen et al. | 209/81 R |
| 3,320,528 | 5/1967 | Esenwein | 324/61 R |
| 3,482,162 | 12/1969 | Wochnowski | 324/61 R |
| 3,671,857 | 6/1972 | Bergmanis | 324/61 QS |
| 3,777,258 | 12/1973 | Wochnowski | 324/61 QS |
| 3,795,984 | 3/1974 | Meyer | 324/61 QS |
| 3,950,698 | 4/1976 | Wochnowski | 324/61 R |

*Primary Examiner*—Allen N. Knowles
*Attorney, Agent, or Firm*—Peter K. Kontler; John Kurucz

[57] ABSTRACT

There are passed through at least one portion of at least one rod-shaped article the electric field lines of a high-frequency electric field joining the electrodes of a measuring capacitor, and a density-dependent measurement signal is generated by detecting the effect upon the capacitance of the capacitor of the passage of the field lines through the article. There are passed through a reference dielectric medium the electric field lines of a high-frequency electric field joining the electrodes of a measuring capacitor, and a comparison signal is generated by detecting the effect of the reference dielectric medium upon the capacitance of the capacitor. The measurement signal and comparison signal are automatically compared to form a compensated density-dependent signal.

49 Claims, 11 Drawing Figures

METHOD AND APPARATUS FOR MONITORING THE DENSITY OF ROD-SHAPED ARTICLES, PARTICULARLY CIGARETTES AND THE LIKE

CROSS-REFERENCE TO RELATED APPLICATION

The present application is a containuation-in-part of my copending commonly assigned application Ser. No. 499,900, filed Aug. 23, 1974, and entitled "APPARATUS FOR TESTING THE END PORTIONS OF CIGARETTES OR THE LIKE." The entire disclosure of application Ser. No. 499,900 is incorporated herein by reference.

BACKGROUND OF THE INVENTION

The invention relates to a method for determining by capacitive means the density or total mass of rod-shaped articles dealt with by the tobacco processing industry, such as cigarettes, cigars, cigarillos, filter rods, rod-shaped streams of tobacco or other smokers' material, and other rod-shaped smoker's products. More particularly, the invention relates to the type of mass measuring method in which a high-frequency voltage is applied across the electrodes of a capacitor and the electric field lines joining the capacitor electrodes are caused to pass through the material of at least a portion of the rod-shaped article, with the effect of the mass of material penetrated by such field lines upon the capacitance of the capacitor being directly or indirectly detected to yield a measurement signal indicative of mass or density.

The invention also relates to apparatus for measuring the mass of tobacco or other material in a cigarette or other such rod-shaped article when the articles are conveyed spaced from each other along a predetermined path, and with the electric fields lines joining two electrodes of a capacitive mass or density measuring arrangement across which a high-frequency voltage is applied passing through the material of at least a predetermined portion of the rod-shaped article.

Capacitive density and mass measurement methods, due to the use of high-frequency voltages, are particularly susceptible to errors due to drift phenomena such as cause the measured value to slowly migrate, and this can lead to imprecision or to measurement errors. It is known to reduce the possibility of drift phenomena by using stabilized circuits. However, these despite their additional cost usually do not completely solve the problem.

SUMMARY OF THE INVENTION

It is accordingly a general object of the invention to provide a way of counteracting or reducing the effect of disturbance variables upon the results of capacitive mass or density measurement methods, particularly as applied to cigarettes or analogous rod-shaped articles, to an extent sufficient for practical requirements.

This object, and others which will become more understandable from the description, below, of preferred embodiments, can be met, according to one advantageous concept of the invention, by comparing the uncompensated mass or density measurement signal with a comparison signal which is independent of the mass or density and which is generated by performing a capacitive mass measurement upon a reference dielectric medium during the time interval between the mass or density measurements of two successive rod-shaped articles each penetrated by the high-frequency electric field lines joining the two electrodes of a measuring capacitor. It is particularly advantageous to use for the reference dielectric medium air, particularly the air actually in the space intermediate successive ones of the rod-shaped articles. This expedient makes it possible to virtually eliminate the effect upon the measurement signal of drift phenomena resulting from distrubances of the high-frequency capacitive measuring circuitry, for example drift phenomena attributable to the temperature, pressure and moisture content of the air with which the material whose density or mass is to be measured is mixed.

For example, if the ambient air, and particularly the air located intermediate successive cigarettes, is employed for the reference dielectric medium, then the performance of a capacitive measuring operation upon this air yields a comparison signal which is independent of the tobacco mass and dependent to a very great degree upon precisely those disturbance variables (e.g., temperature, pressure and mositure content) which detract from the tobacco-density-indicating accuracy of the uncompensated measurement signal. Thus, I provide a particularly simple way of generating a single comparison signal which takes into account all those disturbance variables (including unknown ones) which may detrimentally influence the accuracy of the measurement. It is then particularly simple to effect compensation of the uncompensated measurement signal in dependence upon the comparison signal, to yield a highly accurate, compensated density-indicating signal. At its simplest, this compensation can involve subtracting the comparison signal, or a preselected fraction thereof, from the measurement signal. While it is particularly simple to employ for the reference dielectric medium the ambient air or other gaseous atmosphere, it would also be possible to employ another material, perhaps even a solid, whose dielectric characteristics undergo changes such as would yield a useful comparison signal.

The inventive expedient is advantageously applied in a monitoring device of a filter cigarette machine. In this machine, the rod-shaped articles (e.g., cigarettes) are transported while oriented transverse to the transport direction. With such machines, it is often desired to monitor the heads (also called the cigarette ends) to make sure that these are sufficiently filled with tobacco. According to an advantageous concept of the invention, this is achieved by causing the field lines of the high-frequency electric field to penetrate the material of the articles only in the region of their ends. To this end, according to another concept of the invention, the articles, before their respective ends are penetrated by the field, are oriented in a particular manner in preparation for the penetration by the field.

According to another advantageous concept of the invention, the cigarettes are oriented parallel to the direction of their transport, for example as is the case in a so-called cigarette rod machine wherein the rod-shaped articles are formed by repeatedly severing the end segment of an endless (continuously formed) rod and by thereafter establishing a spacing between successive articles by accelerating them. With such machines, it is often desired to monitor the density or total mass of the formed cigarettes as they leave the machine, particularly for the purpose of detecting substandard density or mass and discarding the defective articles before they are subjected to further processing.

According to another advantageous concept of the invention, there is formed a difference signal corresponding to the difference between the uncompensated measurement signal and the comparison signal. When the value of the difference signal deviates from a preselected standard, there is generated a defect signal serving to control the removal of the defective rod-shaped article from its conveyor.

Errors in the results of the capacitive mass or density measurement can also result from not performing the measurement at exactly the right moment, which is when the rod-shaped article has assumed a definite position relative to the electrodes of the capacitive measuring arrangement. It is already known to deal with this problem by using one or more synchronizers, operative for causing the measurement to be performed at a moment corresponding to assumption by the rod-shaped article of the correct measurement position. However, these synchronizers, as designed heretofore, do not work with absolute accuracy, and absolute accuracy is necessary to assure that each time the measurement is performed the article is precisely in the measurement position,, for example exactly centered relative to the two measuring electrodes. Drift phenomena resulting from imperfect synchronization are greatly reduced or entirely eliminated, according to another concept of the invention, if the uncompensated measurement signals and the comparison signals are interleaved to form a continuous signal flow whose extreme-value-containing portions (maxima- and minima-containing portions) are formed by the measurement and comparison signals. The moment at which one of the two signals reaches an extreme value is detected, and at this moment the signal is compared to the other signal. With this expedient, it will usually be appropriate to derive from the selected signal the time-derivative waveform as a control signal and then use this time-derivative waveform to determine the moment at which the selected one of the two signals is to be compared with the other of the two signals. This makes unnecessary the use of conventional synchronizers, and the signal generated by the capacitive measurement arrangement itself serves to determine the times at which the measurements or comparisons are to be performed.

The moment at which an extreme value is reached can be very accurately determined by continuously deriving from the signal waveform its time-derivative waveform and detecting when the instantaneous value of the time-derivative waveform reaches a preselected threshold value. As well known, the formation of the first derivative of a waveform makes it possible to determine the slope of the original waveform at any particular point. The slope of the first-derivative waveform equals zero whenever the original waveform has a maximum or a minimum (assuming that the original waveform has a continuous second derivative. The zero-value points of the first-derivative waveform can be readily determined by inexpensive electronic means. Accordingly, the aforementioned use of a time-derivative computation for evaluating a continuously changing signal generated in the course of employing the capacitive measurement method makes the capacitive measurement method usable for the generation of high-accuracy control signals.

By appropriately selecting the size of the measuring capacitor (most advantageously corresponding in its extension to approximately the distance between two rod-shaped articles), the aforementioned expedient makes it possible to accurately determine the moment at which the rod-shaped article, or alternatively the space intermediate two successive articles, is located exactly centered relative to the electrodes of the measuring capacitor of the capacitive measurement arrangement.

One can detect the moment at which the comparison signal reaches an extreme value or the moment at which the measurement signal reaches its extreme value or the moments at which the comparison signal and the measurement signal reach their extreme values, and then perform the comparison of these two signals at such moments. Distinguishing between an extreme value of a comparison signal and an extreme value of a measurement signal is easiest if the measurement signals and comparison signals respectively form distinguishable extreme values (e.g. maxima and minima, respectively) of the signal flow. The comparison signal, for example, forms a minimum in the signal flow when, as earlier described, it is generated by the capacitive measurement of air. However, the comparison signal can also be derived using a circuit so formed that the measurement arrangement derives from it a comparison signal constituting a desired-value signal for the cigarettes to be monitored. During the next operating cycle --i.e., until the next or the same phantom is detected by the measurement arrangement for forming a comparison signal by detecting an extreme value-- it need only be determined whether in such time interval the desired value is actually reached, which can be done for example using a comparator. With this expedient, the phantoms advantageously alternate with the rod-shaped articles on the conveyor for the articles.

The arrangement described above is particularly well suited for the performance of the aforedescribed method. The capactive measurement arrangement is characterized by the fact that it has connected to its output a comparing arrangement for generating a signal (difference signal) corresponding to the difference between a tobacco-density-dependent measurement signal and a tobacco-density-independent comparison signal, with the comparison signal being formed by using the capacitive measurement arrangement to measure the characteristics of a reference dielectric medium which occupies the measurement location adjoining the measurement electrodes during the interval between the monitoring of one and the next cigarette.

The invention is particularly well suited for capacitive measurement arrangements having two electrodes which are stationary relative to a conveyor for the cigarettes or other rod-shaped articles. According to a preferred concept of the invention, the comparing arrangement includes a storage for receiving and storing a cigarette-independent comparison signal generated using the capacitive measurement arrangement. One input of a subtractor is connected to the output of such storage, while the other input is connected with the capacitive measurement arrangement to receive a measurement signal dependent upon the density of the material in a cigarette. According to a particularly advantageous concept of the invention, the comparison signal can be readily formed by using the capacitive measurement arrangement to measure the air which, instead of a rod-shaped article, occupies the measurement location during the interval between the measuring of one and the next rod-shaped article.

An advantageous application of the invention is to the monitoring of the front ends of filter cigarettes in a filter cigarette machine of the type wherein the cigarettes are transported on the conveyor (test conveyor) while oriented transverse to the transport direction. To monitor the front ends, the electrodes of the capacitive measurement arrangement are so arranged relative to the cigarettes that the field lines joining the electrodes pass through the cigarettes only in the region of the cigarette ends. For accurately determining the tobacco density of the cigarette ends, an exact position of the cigarettes to be monitored relative to the electrodes of the measuring arrangement is advantageous. According to an advantageous concept of the invention, there is provided a positioning device for positioning the ciagarette ends relative to the electrodes of the capacitive measurement arrangement. According to a further concept of the invention, a positioning expedient which is mechanically simple and reliable involves the use of a stationary aligning cam against which the cigarette ends glide and which serves to cause the cigarettes to shift in longitudinal direction unntil properly lines up.

The invention can also be used with a so-called rod machine on which the cigarettes are actually formed. The capacitive measurement arrangement makes it possible to monitor deviations in the density of the produced cigarettes from preselected standards. According to another concept of the invention, a particularly advantageous measurement location --i.e., location for the measurement electrodes-- is the location at which is provided an accelerating device for creating spaces between each successively formed cigarettes.

The output of the comparing arrangement can be connected to an evaluating device for the difference signal. The evaluating device in turn is advantageously connected to the control input of a rejecting device operative, when the difference signal falls outside a preselected range of acceptable values, for effecting ejection of the defective rod-shaped article from the conveyor upon which it is travelling.

Drift phenomena affecting the signals to be evaluated can result from the use of insufficiently accurate synchronizers for the timing of the formation of the measurement signals to be used. According to a further concept of the invention, such drift phenomena can be eliminated by connecting to the measurement arrangement a circuit arrangement which receives the signal flow of measurement and comparison signals, with these signals forming extreme values in the signal flow. The circuit arrangement detects the movement at which one of the two signals reaches an extreme value. The circuit arrangement is connected to the comparing device and applies to the latter a control signal at the moment in question, thereby effecting the application of the respective one of the two signals to the comparing arrangement. A particularly well suited circuit arrangement for detecing the extreme values includes a differentiator and a threshold stage (e.g., a Schmitt trigger). The circuit arrangement can be provided with means for detecting the extreme values of the comparison signals, or of the measurement signals, or of both.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2:
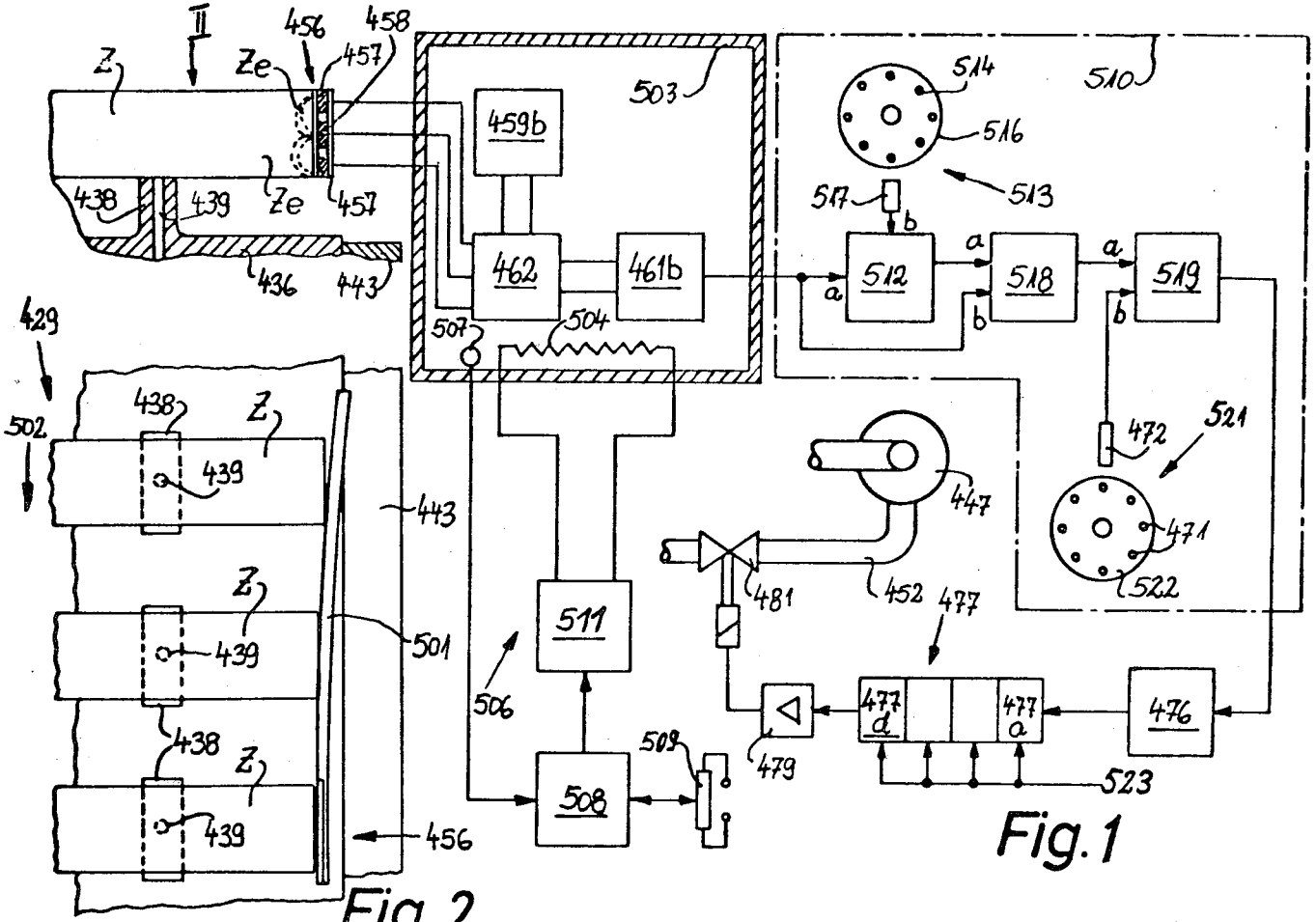
FIG. 1 depicts partly in section a testing drum of a filter cigarette machine provided with a capacitive measurement arrangement for determining the density of cigarette ends.
FIG. 2 is a top view of the arrangement of FIG. 1, as seen in the direction of the arrow II in FIG. 1.

The testing conveyor 429 of FIGS. 1 and 2 corresponds to the testing conveyor 429 of FIGS. 6 and 7 of my copending and commonly assigned application Ser. No. 499,900 filed Aug. 23, 1974, and entitled "Apparatus for Testing the End Portions of Cigarettes or the Like." The conveyor 429 of FIGS. 1 and 2 of the present description accordingly also corresponds to the conveyor 29 in FIGS. 1 and 2 of my application Ser. No. 499,900, the entire disclosure of which is incorporated herein by reference.

In FIGS. 1 and 2 herein, there is shown the rotary drum-shaped body 436, several flutes 438, their suction ports 439 and a valve plate 443 which is adjacent to the right-hand end face of the body 436. The capacitive measuring arrangement 456 is comprised of an annular electrode 457 and arranged concentric thereto an electrode 458. The electrodes 457, 458 are arranged at the end of a stationary cam 501 which constitutes a shifting or aligning means for moving the tobacco-containing end portions Ze of successive cigarettes Z into an optimum position with respect to the electrodes 457, 458. In the illustrated embodiment, the electrodes 457, 458 are mounted directly on or in the end portion of the cam 501. The arrow 502 indicates the direction of rotation of the body 436. The force with which suction in the ports 439 attracts cigarettes Z to the respective flutes 438 is rather weak so that the stationary cam 501 can readily shift those cigarettes Z whose end portions Ze are not in an optimum position for testing by the capacitor 456 at the time the cigarettes are transferred onto the body 436 (e.g., from the transfer conveyor 28 of FIG. 1 of my copending application).

The measuring arrangement 456 comprises a high-frequency voltage source 459*b* which applies across the electrodes 457, 458, which serve as the electrodes of the frequency-determining capacitor of a per se known type of resonant circuit 462, a high-frequency voltage having a constant frequency stabilized by means of a quartz crystal. An example of such an oscillator is disclosed in the "RCA-Transistor Manual," 1967, page 507, of the Radio Corporation of America. An electrical quantity (voltage, current) of the resonant circuit has a amplitude dependent upon the mass of tobacco in the cigarette ends penetrated by the field lines joining the electrodes 457, 458. An evaluating device 461*b* evaluates the amplitude of this electrical quantity and generates at its output a measurement signal dependent upon the tobacco mass.

The individual components 459*b*, 462 and 461*b* are located in a housing 503 which can be warmed by means of a heating resistor 504. To maintain constant the temperature in the housing 503, use is made of a temperature regulator 506 which, besides the heating resistor 504, furthermore comprises a temperature sensor 507 located in the housing 503, a comparison stage 508 (for example a difference amplifier) and a regulator amplifier 511. The temperature regulator 506 serves to maintain constant the temperature of the electrical components of the capacitive measuring arrangement 456 inside the housing 503, to reduce drift phenomena resulting from temperature fluctuations.

To further suppress drift phenomena, there is connected to the output of the capacitive measuring arrangement 456 a comparison stage 510 operative for generating a difference signal corresponding to the difference between the measurement signal dependent upon the tobacco density in the cigarette end Ze and a comparison signal independent of the tobacco density. To this end, the output of the evaluating device 461*b* is connected to the input of a sample-and-hold device 512 (at its simplest an RC circuit charged via an electronic switch). The sample-and-hold device 512 receives sampling pulses at its input *b* from a synchronizer 513. Each time sample-and-hold device 512 receives a sampling pulse at its input *b*, the value of the signal applied to its input a is sampled and then held until receipt of the next sampling pulse from snychronizer 513. The synchronizer 513 is comprised of a synchronizer disk 516 provided with control cams, light-passing perforations, or the like, and a cooperating proximity detector 517, such as a limit switch, photoresponsive electronic switch, or the like. The synchronizer disk 516 is synchronized with the drive of the machine in such a manner that the proximity detector 517 generates a sampling pulse only when, instead of a cigarette Z, there is lined up with the electrodes 457, 458 one of the intermediate spaces between successive cigarettes Z. At such moment the output signal of evaluating circuit 461*b* constitutes a comparison signal which is not dependent upon the tobacco mass, by using for the dielectric material of the capacitor whose electrodes are constituted by the electrodes 457, 458 the air present in the vicinity of the electrodes. This comparison signal is then applied to the sample-and-hold device 512. The output of the device 512 is connected to an input a of a subtractor 518, to apply the comparison signal to the input *a*. The other input *b* of subtractor 518 receives directly the signal at the output of the evaluating device 461*b*. The difference signal at the output of subtractor 518, corresponding to the difference between the measurement signal and the comparison signal, is applied to the input *a* of a gating circuit 519 whose output is connected to the input of a threshold circuit, here a Schmitt trigger 476. The input *b* of the gating circuit 519 receives gating signals from the output of a synchronizer 521. The synchronizer 521 comprises a synchronizer disk 522 and a cooperating proximity detector 472. The synchronizer 521 generates a gating signal each time that a cigarette Z moves into exactly the measuring position in front of the electrodes 457, 458. This expedient assures that there are applied to the input of the Schmitt trigger 476 only signals actually corresponding to the difference between the measurement signal and a comparison signal. This difference is to a great extent independent of changes in the absolute value of the measurement signal such as result from undesired drift effects. If the difference falls outside a preselected range of acceptable values, then the Schmitt trigger 476 generates and applies a defect signal to the information-signal input of a shift register 477. The defect signal is transferred from one shift-register stage 477*a*. . . 477*d* to the next in synchronism with the application of shift signals to the shift-signal input 523 of the shift register. When the defect signal reaches the last shift register stage it is applied to the input of an amplifier 479 and then in amplified form to the winding of an electromagnet valve 481. This causes the valve 481 to open, permitting pressurized air from a ventilator 447 to pass through conduit 452 and emerge as an air blast which expels the cigarette having a defective end. The shift register 477 affords a time delay corresponding to the time required for the defective cigarette to pass from the mass measurement station to the location at which it should be ejected.

When the tobacco mass measurement is performed upon the ends of a plurality of cigarettes arranged in pack formation (a so-called cigarette block consisting of twenty cigarettes, for example), the effects of drift phenomena can be reduced in a similar manner.

Figure 3:
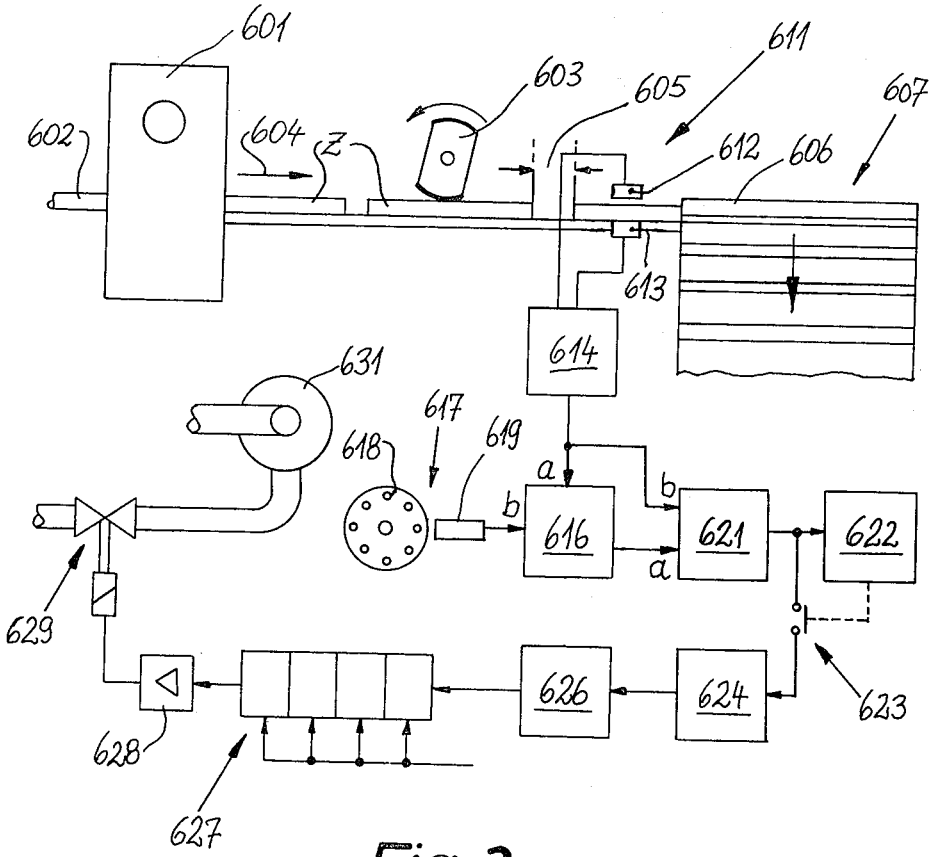
FIG. 3 depicts the transfer station of a cigarette rod machine provided with a capacitive measurement arrangement for determining the density of the cigarettes.

FIG. 3 depicts the transfer station of a per se known cigarette rod machine, further details of which are not depicted, because they may be had, for example, from U.S. Pat. No. 3,672,373.

A cutting device 601 having a rotating cutting knife forms individual cigarettes Z from an endless cigarette rod 602. The cigarettes are separated from one another by an accelerator having the form of a rotating cam 603. The peripheral speed of the accelerating surface of the accelerator cam 603 is greater than the speed with which the cigarettes Z leave the cutting device 602, so that the cigarettes become accelerated in the direction of arrow 604. As a result, intermediate spaces 605 are formed between the individual successive cigarettes Z. The cigarettes which have been accelerated, and accordingly separated from the following cigarettes, are transferred into the flutes 606 of a transfer drum 607 which carries the cigarettes away to a location where they are processed further, for example to a filter attaching machine.

A measuring device 611 is used for determining the tobacco density in the cigarettes, employing the capacitive density measuring method. It is comprised of two electrodes 612, 613 serving as the electrodes of the frequency-determining capacitor of a resonant circuit (like circuit 462 in FIG. 1). This resonant circuit is driven by a high-frequency voltage whose frequency is stabilized by means of a quartz crystal and supplied by a high-frequency voltage source (like 459*b* in FIG. 1). An evaluating device (like 461*b* in FIG. 1) generates a tobacco-mass-dependent output signal after evaluating the tobacco-mass-dependent amplitude of an electrical quantity (voltage, current) of the resonant circuit. These circuit components are located in a housing (like 503 in FIG. 1) designated 614 in FIG. 3. The output signal furnished by the circuit in housing 614 is applied to input a of a sample-and-hold device 616. The sampling by device 616 of the value of the signal at its input a is controlled by a synchronizer 617 comprised of a synchronizer disk 618 and a proximity detector 619. The synchronizer disk 618 is synchronized with the drive of the machine in such a manner that the proximity detector 619 applies a sampling pulse to the sampling pulse input *b* of storage device 616 when only air is present between the electrodes 612, 613.

A comparison signal formed at one of these moments by performing a capacitive mass measurement of the air between the electrodes is held by sample-and-hold device 616. The output of the analog storage device 616 is connected to input a subtractor 621 whose output *b* receives directly from the output of the circuit in housing 614 output signals dependent upon the tobacco content in the cigarette ends. The subtractor 621 forms a difference signal corresponding to the difference between the instantaneous value of the signal generated at the output of the circuit in housing 614 and the value held by sample-and-hold device 616. The latter, as already mentioned, was formed at a moment during which only air was present between the electrodes 612, 613. The output signal of subtractor 621 is applied, on the one hand, to the input of a threshold circuit 622 (e.g., a Schmitt trigger) and, on the other hand, via an electronic switch 623 controlled by the threshold circuit 622, to the input of an integrator circuit 624. The threshold circuit 622 renders the electronic switch 623 conductive when the signal applied to circuit 622 has reached a certain value preselected in such a manner as to indicate that a cigarette is present in the sensing range of the electrodes 612, 613. The output signal of integrator circuit 624 is applied to the input of a threshold circuit 626 (e.g., a Schmitt trigger) at whose output appears a defect signal when the detected cigarette mass does not fall within a preselected range of acceptable values to which the switching level of the threshold circuit 626 has been set to correspond. Such defect signal is applied through a shift register 627 and via an amplifier 628 to the solenoid of a solenoid valve 629 which responds by opening to thereby permit pressurized air from source 631 to emerge as a blast ejecting the defective cigarette. As before, the shift register 627 supplies a time delay corresponding to the time required for the defective cigarette to travel from the tobacco mass measuring location to the ejection location.

The density measurement signals for the tobacco in the cigarettes Z can be evaluated in other ways, for example by being fed to a computer or storage device for statistical processing.

Figure 4:
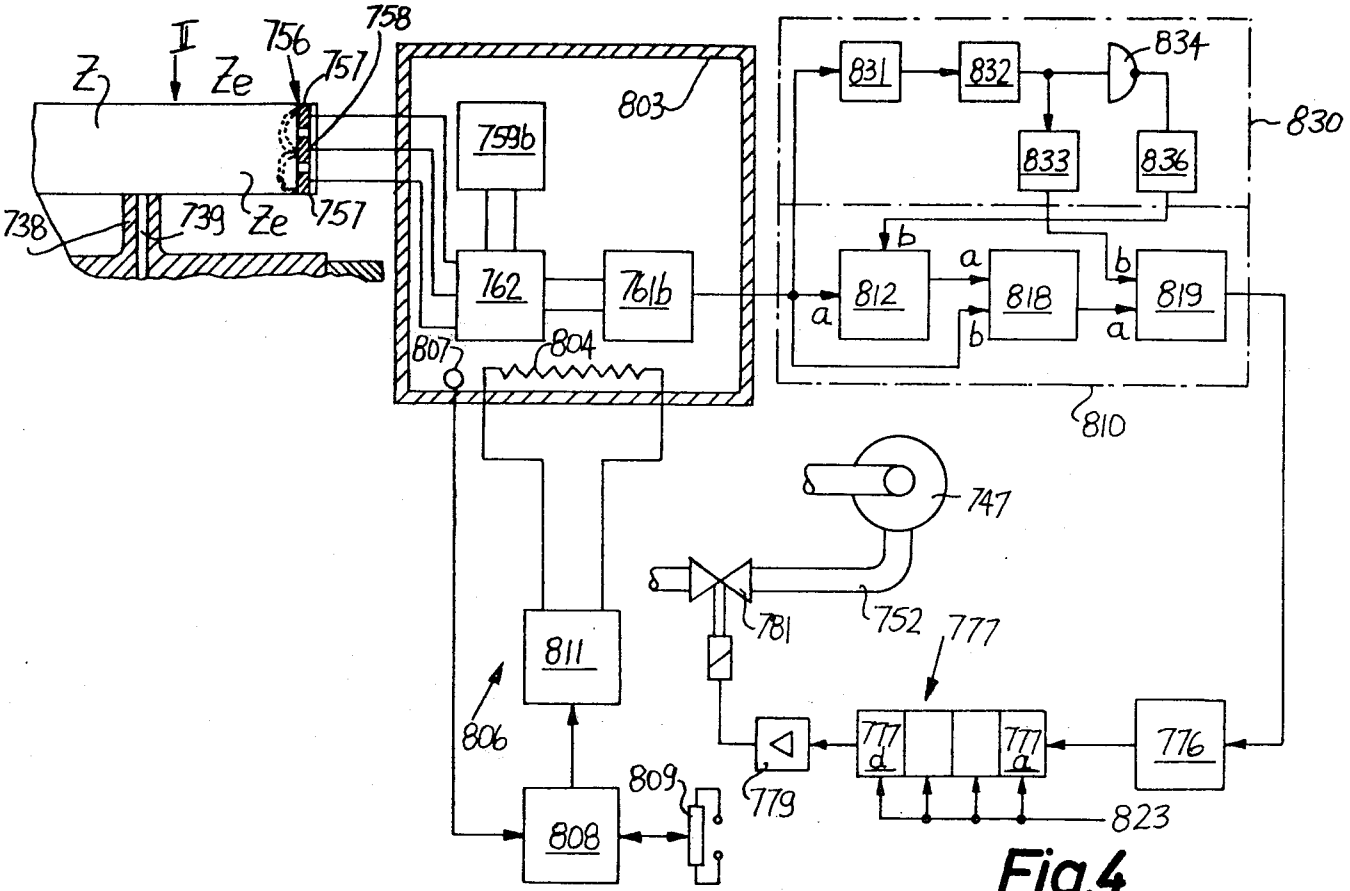
FIG. 4 depicts a variant of the embodiment of FIGS. 1 and 2.

FIG. 4 depicts a variation of the embodiment of FIG. 1, corresponding parts being designated by the same reference numerals, increased by 300, and not described herein again.

Figure 5:
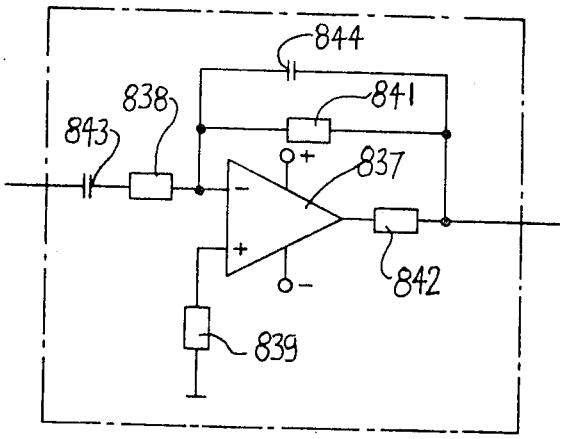
FIG. 5 is the circuit diagram of a differentiator which can be used.
Figure 6A:
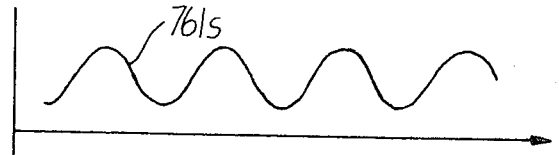
FIGS. 6*a*–6*f* depicts the output waveforms of indicated ones of the circuit components in FIG. 4.
Figure 6B:
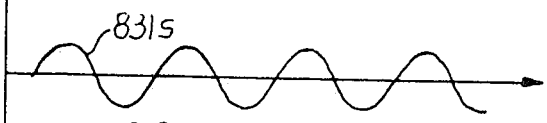
Figure 6C:
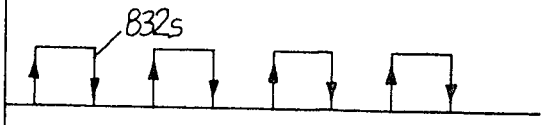
Figure 6D:
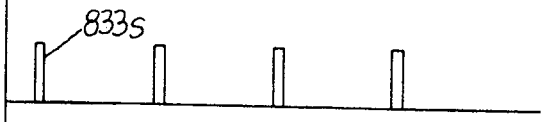
Figure 6E:
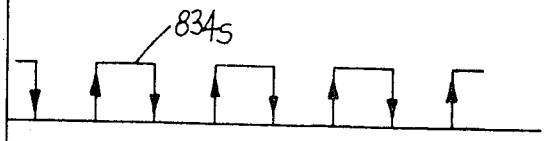
Figure 6F:
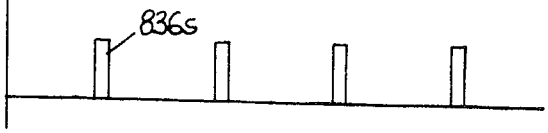

The difference relative to the embodiment of FIG. 1 is that both synchronizers are replaced by a circuit 830. Circuit 830 comprises a differentiator 831, a threshold circuit 832, a NOT-gate 834, and two pulse formers 833 and 836. An exemplary circuit diagram of a suitable differentiator is shown in FIG. 5. The circuit comprises an operational amplifier 837 for inverting the phase of the input signal, resistors 833–842, and capacitors 843 and 844. The threshold circuit 832 can for example be of the type kknown as LM 301 made by the National Semiconductor Corporation. The pulse formers can be ordinary monostable multivibrators.

FIGS. *6b–6f* are output waveform diagram for the individual circuit components of circuit 830, as related to the output waveform diagram for the component 761 in FIG. 4. In FIGS. *6b–6f* the waveforms are designated by the same numeral as the respective circuit component, but with the addition of the letter *s*. As can be seen from the waveform diagrams, the differentiator 831, the threshold circuit 832 and the pulse former 833 together form a means for determining the extreme values (maxima) of the measurement signal, whereas the differentiator 831, the threshold circuit 832, the NOT-gate 834 and the pulse former 836 together form a means for determining the extreme values (minima) of the comparison signal. In other words, the pulse former 833 generates a pulse whenever the end Ze of a cigarette Z moves into a centered position relative to the electrodes 757 and 758. In other respects, the operation of this circuit corresponds to that of FIG. 1. It has the advantage that the arrival of a cigarette at the desired measurement position or the presence of the reference dielectric medium at the measurement position is detected by monitoring the value of the measurement signal itself, thereby adding to the dependability with which the proper moments for the evaluation of the measurement and comparison signals are automatically selected.

It will be understood that each of the elements described above, or two or more together, may also find a useful application in other types of circuits and constructions differing from the types described above.

While the invention has been illustrated and described as embodied in a variety of apparatus and methods for measuring the specific density or average density of the tobacco in a cigarette, it is not intended to be limited to the details shown, since various modifications and structural changes may be made without departing in any way from the spirit of the present invention.

In particular, it will be clear that the invention is applicable not only to cigarettes, but also to cigars, cigarillos, other smokers' products and parts thereof, not necessarily containing tobacco.

In the illustrated embodiments, for simplicity, the compensated density-indicating signal was formed by simply subtracting the magnitude of the comparison signal from the magnitude of the measurement signal. However, the relevant values of the measurement and comparison signals may not be their magnitudes, but could instead by, for example, their frequencies, phase, amplitude, or the like. Likewise, the relevant values of the measurement, comparison and compensated density-indicating signals need not be all expressed in the same characteristic, such as magnitude, but could for example be frequency, amplitude and magnitude, respectively, although the expedient of the disclosed embodiments is considered preferable.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters patent is set forth in the appended claims:

1. A method of monitoring the density of rod-shaped articles, particularly cigarettes, cigars, cigarillos, other smokers' products and parts thereof, comprising, in combination, the step of passing through at least one portion of at least one such article the electric field lines of a high-frequency electric field joining the electrodes of a capacitor, and generating a density-dependent measurement signal by detecting the effect upon the capacitance of the capacitor of the passage of the field lines through the article; the step of passing through a reference dielectric medium the electric field lines of a high-frequency electric field joining the electrodes of a capacitor, and generating a comparison signal by detecting the effect of the reference dielectric medium upon the capacitance of the capacitor; and the step of combining said measurement signal and said comparison signal to form a compensated density-dependent signal.

2. A method as defined in claim 1, wherein said steps of generating the measurement signal and the comparison signal comprise using for the generation of both signals the same capacitor.

3. A method as defined in claim 1, the method being applied to a series of such rod-shaped articles successively, and wherein said step of generating a comparison signal is performed during the time interval between the generation of one and the next measurement signal.

4. A method as defined in claim 1, the method being applied to a series of rod-shaped articles successively, wherein said steps of generating the measurement signal and the comparison signal comprise transporting a series of spaced rod-shaped articles successively through the region penetrated by said field lines with said dielectric medium occupying the spaces between successive rod-shaped articles so that said field lines alternately penetrate through a rod-shaped article and through the reference dielectric medium.

5. A method as defined in claim 1, wherein said steps of generating said measurement signal and said comparison signal comprise gnerating said signals non-simultaneously.

6. A method as defined in claim 1, wherein said steps of generating said measurement signal and said comparison signal generating said signals non-simultaneously, and wherein said step of generating said difference signal comprises generating said difference signal simultaneously with one of said measurement signal and said comparison signal.

7. A method as defined in claim 1, wherein said steps of generating said measurement signal and said comparison signal comprise generating a measurement signal and a comparison signal having amplitudes corresponding respectively to the density of said material and to the electrical characteristics of said medium.

8. A method as defined in claim 1, wherein said step of generating said comparison signal comprises generating a comparison signal having an amplitude corresponding to the difference in the amplitudes of said measurement and comparison signals.

9. A method as defined in claim 1, wherein said reference dielectric medium is ambient air.

10. A method as defined in claim 4, wherein said reference dielectric medium is ambient air.

11. A method as defined in claim 4, wherein said steps of generating the measurement and comparison signals comprise transporting said series of rod-shaped articles with the articles extending transverse to the transport direction.

12. A method as defined in claim 1, wherein said step of generating the measurement signal comprises passing said electric field lines through substantially only an end portion of the rod-shaped article.

13. A method as defined in claim 4, wherein said transporting comprises transporting said articles towards said electrodes with the ends of said articles not aligned, but aligning said ends before said articles successively reach said electrodes.

14. A method as defined in claim 4, further including the step of repeatedly cutting off the end portion of an elongated travelling rod to form the individual successive ones of said series of rod-shaped articles, accelerating the individual articles to create intermediate spaces between successive ones, and transporting the spaced rod-shaped articles through said field lines with the articles oriented parallel to the transport direction.

15. A method as defined in claim 1, wherein said step of generating the measurement signal comprises progressively passing successive portions of the entire rod-shaped article through the region occupied by said field lines and generating a corresponding density-indicating signal, forming an integral signal corresponding to the time integral of the density-indicating signal during the interval required for the passage of the entire article through said region so as to form a density-indicating measurement signal indicative of the average density of the entire article.

16. A method as defined in claim 1, wherein said step of comparing said measurement signal and said comparison signal comprises forming a difference signal having a value corresponding to the difference in the values of said measurement signal and said comparison signal, said difference signal constituting said compensated density-dependent signal.

17. A method as defined in claim 16, further including the steps of generating a defect signal when the value of the difference signal falls outside a preselected range of acceptable values and applying the defect to an ejection device.

18. A method as defined in claim 16, wherein said steps of generating the measurement and comparison signals comprise generating a single signal flow in which measurement and comparison signals are interleaved and alternate with each other in correspondence to the alternate passage through said region of successive ones of said articles and the reference dielectric medium and in which said measurement and comparison signals constitute extreme-value-containing portions of said signal flow, and wherein said step of comparing comprises detecting when one of said interleaved signals reaches and extreme value and at that moment effecting the comparison.

19. A method as defined in claim 18, wherein said detecting when one of said interleaved signals reaches an extreme value comprises forming from said signal flow the firstderivative waveform thereof and detecting when the instantaneous value of said first-derivative waveform reaches a preselected thereshold value.

20. A method as defined in claim 18, wherein said detecting when one of said interleaved signals reaches an extreme value comprises detecting when the measurement signal reaches an extreme value.

21. A method as defined in claim 18, wherein said detecting when one of said interleaved signals reaches an extreme value comprises detecting when the comparison signal reaches an extreme value.

22. A method as defined in claim 16, the measurement signals and the comparison signals including extreme values of said signal flow respectively distinguishable from each other.

23. A method as defined in claim 4, wherein said steps of generating the measurement and comparison signals comprise generating the measurement and comparison signals alternately in correspondence to the alternate passage through said region of successive ones of said articles and the reference dielectric medium, and wherein said step of comparing comprises storing the value of each successive one of the measurement signals until the generation of the respective next-following comparison signal and thereupon forming a difference signal having a value corresponding to the difference between the value of the stored measurement signal and the respective next-following comparison signal and constituting the compensated density-dependent signal.

24. A method as defined in claim 4, wherein said steps of generating the measurement and comparison signals comprise generating the measurement and comparison signals alternately in correspondence to the alternate passage through said region of successive ones of said articles and the reference dielectric medium, and wherein said step of comparing comprises storing the value of each successive one of the comparison signals until the generation of the respective next-following measurement signal and thereupon forming a difference signal having a value corresponding to the difference between the value of the stored comparison signal and the respective next-following measurement signal and constituting and compensated density-dependent signal.

25. An apparatus for monitoring the density of rod-shaped articles, particularly cigarettes, cigars, cigarillos, other smokers' products and parts thereof, comprising, in combination, conveying means for conveying a series of such articles spaced from one another in a predetermined path with a reference dielectric medium occupying the spaces between successive articles; capacitive measuring means comprising a source of high-frequency alternating voltage, a measuring capacitor comprised of measuring electrodes connected across said source and so disposed that a high-frequency alternating electric field joining said electrodes has field lines which extend through a predetermined region of space and penetrate alternately the reference dielectric medium and the material of at least predetermined parts of successive ones of the articles, and signal-generating means for forming measurement signals indicative of the density of the rod-shaped articles and comparison signals indicative of the dielectric property of the reference dielectric medium by detecting the effect of material penetrated by said field lines upon the capacitance of said measuring capacitor; and compensating means for modifying said measurement signals in dependence upon said comparison signals to produce compensated density-indicating signals.

26. An apparatus as defined in claim 25, wherein said compensating means comprises subtracting means operative for generating said compensated density-indicating signals by subtracting the comparison signals from the measurement signals.

27. An apparatus as defined in claim 25, wherein said electrodes are stationary with respect to said conveying means.

28. An apparatus as defined in claim 25, wherein said signal-generating means comprises means operative for generating said measurement signals and said comparison signals alternately in correspondence to the alternate penetration by said field lines of the articles and the reference dielectric medium in the spaces between successive articles.

29. An apparatus as defined in claim 28, wherein said compensating means comprises signal-storing means for receiving ans storing each measurement signal until the generation of the next comparison signal and means operative upon such generation of said next comparison signal for effecting the compensation.

30. An apparatus as defined in claim 28, wherein said compensating means comprises signal-storing means for receiving and storing each comparison signal until the generation of the next measurement signal and means operative upon such generation of said next measurement signal for effecting the compensation.

31. An apparatus as defined in claiim 28, wherein said compensating means comprises signal-storing means for receiving and storing each measurement signal until the generation of the next comparison signal and subtracting means having one input connected to the output of said signal-storing means for the receipt of the stored measurement signal and having another input connected to the output of said signal-generating means for receipt of the comparison signals generated thereby and operative for forming the difference between the measurement signal stored by said signal storing means and the comparison signal generated by said signal-generating means in synchronism with the generation of the comparison signal.

32. An apparatus as defined in claim 28, wherein said compensating means comprises signal-storing means for receiving and storing each comparison signal until the generation of the next measurement signal and subtracting means having one input connected to the output of said signal-storing means for the receipt of the stored comparison signal and having another input connected to the output of said signal-generating means for receipt of the measurement signals generated thereby and operative for forming the difference between the comparison signal stored by said signal storing means and the measurement signal generated by said signal-generating means in synchronism with the generation of the measurement signal.

33. An apparatus as defined in claim 25, wherein said reference dielectric medium is air.

34. An apparatus as defined in claim 25, wherein said conveying means comprises means for transporting the rod-shaped articles with the articles oriented transverse to the transport direction.

35. An apparatus as defined in claim 34, the rod-shaped articles being cigarettes, and wherein said electrodes of said measuring capacitor are so dimensioned and disposed that said field lines penetrate only the end portions of successive ones of the cigarettes conveyed by said conveying means.

36. An apparatus as defined in claim 34, further including positioning means for properly positioning the rod-shaped articles relative to said electrodes by effecting relative movement between the rod-shaped articles and said conveying means as said rod-shaped articles approach said electrodes.

37. An apparatus as defined in claim 36, wherein said positioning means comprises a stationary positioning cam arrangement configurated and disposed to shift said rod-shaped articles in direction parallel to their elongation and relative to said conveying means as said rod-shaped articles approach said electrodes.

38. An apparatus as defined in claim 25, wherein said conveying means includes means for conveying an elongated rod, means for repeatedly cutting off the end segment from the rod to successively form the individual rod-shaped articles, and accelerating means for accelerating the successively formed rod-shaped articles as they are being conveyed to create intermediate spaces between successive ones of the articles.

39. An apparatus as defined in claim 25, and further including evaluating means for evaluating said compensated density-indicating signals to determine whether the indicated density falls within a predetermined range.

40. An apparatus as defined in claim 39, and further including means for ejecting defective rod-shaped articles from said conveying means in response to a determination by said evaluating means that the respective compensated density-indicating signals indicate densities outside said range.

41. An apparatus as defined in claim 25, wherein said signal-generating means comprises means operative for generating said measurement signals and said comparison signals alternately as interleaved extreme-value-containing portions of a single signal flow in correspondence to the alternate penetration by said field lines of the articles and the reference dielectric medium intermediate successive articles.

42. An apparatus as defined in claim 41, said measurement signals and comparison signals constituting two types of signals, respectively, and wherein said compensating means comprises means for receiving and storing successive ones of the first type of signals, extreme-value-detecting means operative for detecting when successive ones of the second type of signals reach an extreme value and means operative upon such detection for effecting the compensation.

43. An apparatus as defined in claim 41, said measurement signals and comparison signals constituting two types of signals, respectively, and wherein said conpensating means comprises means for receiving and storing successive ones of the first type of signals, extreme-value-detecting means operative for detecting when successive ones of the second type of signals reach an extreme value and means operative for forming a compensated density-indicating signal by forming the difference between the stored first type of signal and the second type of signal at the time of detection of the extreme value in the second type of signal.

44. An apparatus as defined in claim 43, wherein said extreme-value-detecting means comprises means for forming the time derivative of said single signal flow and means for determining when the instantaneous value of said time derivative reaches a predetermined value.

45. An apparatu as defined in claim 43, wherein said signals of the first type are the measurement signals.

46. An apparatus as defined in claim 43, wherein said signals of the first type are the comparison signals.

47. An appratus for monitoring the density of rod-shaped articles, particularly cigarettes, cigars, cigarillos, other smokers' products and parts thereof, comprising, in combination, measurement-signal-generating means for generating a measurement signal dependent upon the density of at least a portion of at least one such article but undesirably also dependent upon at least one other characteristic of the article; comparison-signal-generating means for generating a comparison signal less dependent upon density and more dependent upon said other characteristic than is said measurement signal; and compensating means automatically operative for modifying said measurement signal in dependence upon said comparison signal to produce a compensated density-indicating signal less dependent upon said other characteristic and more dependent upon the density of the article than is said measurement signal.

48. An apparatus as defined in claim 47, wherein said measurement-signal-generating means and said comparison-signal-generating means comprise capacitive measuring means for passing a high-frequency alternating electric field through said portion of the article to produce a measurement signal and through a reference dielectric medium to produce a comparison signal independent of the density of the article.

49. An apparatus as defined in claim 48, wherein said reference dielectric medium is air in the vicinity of the article.

* * * * *

UNITED STATES PATENT OFFICE

CERTIFICATE OF CORRECTION

Patent No. 3,993,194 Dated November 23, 1976

Inventor(s) Joachim REULAND

It is certified that error appears in the above-identified patent and that said Letters Patent are hereby corrected as shown below:

Foremost page, left-hand column item [73]: "Korber" should read --Körber--.

Col. 1, line 7, "containuation-in-part" should read --continuation-in-part--;

line 21, "smoker's" should read --smokers'--;

line 36, "fields" should read --field--.

Col. 2, line 7, "distru-" should read --distur- --.

Col. 3, line 23, the second comma should be deleted;

line 57, "derivative." should read --derivative).--.

Col. 5, line 22, "unntil" should read --until-- and "lines" should read --lined--;

line 33, "each" should be deleted;

line 51, "movement" should read --moment--.

Col. 6, line 19, "depicts" should read --depict--.

Col. 8, line 39, "602" should read --601--.

Col. 9, line 9, --of-- should be inserted after "input";

line 61, "kknown" should read --known--;

line 64, "diagram" should read --diagrams--.

Col. 10, line 44, "by" should read --be--;

line 60, "patent" should read --Patent--.

Claim 5, line 3, "gnerating" should read --generating--.

Claim 6, line 3, --comprise-- should be inserted before "generating".

Claim 13, line 2, --step-- should be inserted before "comprises".

Claim 17, line 4, --signal-- should be inserted after "defect".

Claim 18, penultimate line, "and" (first occurrence) should read --an--.

Claim 19, line 4, "firstderivative" should read --first-derivative--

Claim 24, penultimate line, "and" (second occurrence) should read --the--. Claim 31, first line, "claiim" should read --claim--.

Signed and Sealed this

Twenty-ninth Day of March 1977

[SEAL]

Attest:

RUTH C. MASON
*Attesting Officer*

C. MARSHALL DANN
*Commissioner of Patents and Trademarks*